US007803294B2

(12) United States Patent
Pannewitz et al.

(10) Patent No.: US 7,803,294 B2
(45) Date of Patent: Sep. 28, 2010

(54) METHOD AND MEASURING SYSTEM FOR OBTAINING A REFERENCE FOR A POWDER PRESS

(75) Inventors: Thomas Pannewitz, Klein Pampau (DE); Martin Plucinski, Asendorf (DE); Andreas Groth, Schwarzenbek (DE); Andreas Teetzen, Schwarzenbek (DE)

(73) Assignee: Fette GmbH, Schwarzenbek (DE)

( * ) Notice: Subject to any disclaimer, the term of this patent is extended or adjusted under 35 U.S.C. 154(b) by 192 days.

(21) Appl. No.: 11/585,601

(22) Filed: Oct. 24, 2006

(65) Prior Publication Data

US 2007/0096351 A1 May 3, 2007

(30) Foreign Application Priority Data

Nov. 2, 2005 (DE) ..... 10 2005 052 158

(51) Int. Cl.
*B28B 7/04* (2006.01)

(52) U.S. Cl. ..... 264/40.5; 264/40.1; 264/39; 264/109; 425/78; 425/150; 425/171; 419/68

(58) Field of Classification Search ..... 264/39; 419/68

See application file for complete search history.

(56) References Cited

U.S. PATENT DOCUMENTS 6,442,859 B1 * 9/2002 Hinzpeter et al. ..... 33/645
6,535,825 B1 * 3/2003 Okano ..... 702/41
6,567,761 B1 * 5/2003 Modesto et al. ..... 702/82

(Continued)

FOREIGN PATENT DOCUMENTS

DE 101 51 858 A1 5/2003

(Continued)

OTHER PUBLICATIONS

JP 2001-269843 (Wakaoka), Oct. 2001, English language translation, JPO [online], [retrieved on Dec. 23, 2009]. Retrieved from the Internet: http://www19.ipdl.inpit.go.jp/PA1/result/detail/main/wAAAiSaqrTDA413269843P1.htm.*

*Primary Examiner*—Eric Hug
*Assistant Examiner*—Jacob Thomas Minskey
(74) *Attorney, Agent, or Firm*—Vidas, Arrett & Steinkraus, P.A.

(57) ABSTRACT

Method for determining a reference for a powder press, which comprises a die plate for attaching a die and an upper adaptor plate which may be actuated by a drive which is hydraulic, mechanical, electric or the like for attaching an upper punch, a lower adaptor plate which may be actuated by a hydraulic drive for attaching a lower punch or the die plate and at least one distance measuring system for the upper and lower punch and/or the die plate with the following steps: a reference die and at least one reference punch are made, the reference die is attached to the die plate, by an optical measuring device usefully arranged on a base plate and/or die plate, the position of the upper edge of the reference die is measured and the position value stored, the reference die is removed, the adaptor plate with the reference punch previously attached therein, is moved in the direction of the die until the lower edge of the reference punch has reached the stored position of the upper edge of the reference die, the sum of the reference die measurement and the reference punch measurement is obtained as the distance of the adaptor plate from the die plate and stored.

2 Claims, 1 Drawing Sheet

U.S. PATENT DOCUMENTS

| | | | | |
|---|---|---|---|---|
| 2004/0195715 | A1* | 10/2004 | Grobl et al. | 264/40.5 |
| 2005/0039510 | A1* | 2/2005 | Futamura et al. | 72/20.1 |

FOREIGN PATENT DOCUMENTS

| | | | |
|---|---|---|---|
| EP | 0 607 498 | A1 | 7/1993 |
| EP | 1 074 380 | A2 | 7/2000 |
| EP | 100 41 225 | A1 | 3/2002 |
| EP | 1 048 450 | A2 | 6/2009 |
| JP | 57196313 | | 12/1982 |
| JP | 3189098 | | 8/1991 |
| JP | 63093564 | | 4/1998 |
| JP | 11300580 | | 11/1999 |
| JP | 2001269843 | | 1/2001 |

* cited by examiner

METHOD AND MEASURING SYSTEM FOR OBTAINING A REFERENCE FOR A POWDER PRESS

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The conventional structure of a powder press is the arrangement of a die (press die) on a die plate which rests on a machine frame. At least one upper punch and one lower punch cooperate with the die and which are preferably driven by a hydraulic drive. It is known to attach the punch to a so-called adaptor plate which is vertically guided in appropriate guide columns or the like. The punches are directly attached to the adaptor plate or via an adaptor which, in turn, is fastened to the adaptor plate.

It is further known to carry out the compression of the powder in the die according to force and distance parameters. Therefore, force measuring devices are associated with the punches. The distance measurements are carried out by corresponding distance measuring systems. Generally pressure cells are associated with the force measurement.

Naturally, the dimensions of the punches and the die are known and/or may be identified. In order to be able to carry out a very accurate measurement of the distances, a reference is nevertheless required, as the identification of the dimensions, for example of the upper punch, does not indicate anything about its precise height in the press zone, namely in the upper end position. In the prior art, the referencing process is generally carried out by a setter, by means of, for example, an end measure and a straight edge and is subject to variations for each referencing process of one to two hundredths of a millimetre. In this connection, defined positions of the punches are referenced to a defined position of the die. All movements of the punches relate to this reference. When changing the tools, the punches have to be referenced again each time, as the dimensions of the punches and die change. In some situations, a plurality of upper and lower punches and, for example, a centre pin are used which respectively have to be referenced. Such a referencing process is, therefore, time-consuming and does not guarantee the desired consistency. If it is desired to change the forming tools automatically, it is not possible to carry out manual referencing.

The object of the invention is to provide a method for determining a reference for a powder press, which may be automatically carried out and which allows the tools to be automatically changed with, at the same time, sufficiently accurate consistency of the identified reference values.

BRIEF SUMMARY OF THE INVENTION in the method according to claim 1, a reference die and at least one reference punch are made. The configuration of the reference tools does not have to be copied from the forming tools. It is merely important that they have a previously known dimension and a defined edge. With the reference punch, this is the upper edge and with the reference die, this is also the. upper edge. The manufacturing cost for the reference tools is therefore kept within limits.

By means of an optical measuring device arranged on the die plate of the powder press, the position of the upper edge of the reference die is measured, and the measured position value is stored in a memory of the measuring device and/or an electronic control device of the powder press. Optical or similar measuring devices are known, which in the described case ensure an accuracy of up to 1 μm per 50 mm length, for example. The light source is generally a laser and the receiving device a light-sensitive line.

The reference die is then removed. The upper adaptor plate is moved downwards with the reference punch previously attached thereto, until the edge of the reference punch has reached the stored position of the upper edge of the reference die. The sum of the reference punch measurement and the die measurement corresponds to the distance of the upper adaptor plate from the die plate. This distance value is acquired by the machine control and stored. All further movements are detected by the distance measuring devices which are otherwise present.

Determining the reference for the lower punch is carried out in a similar manner, by the lower adaptor plate being raised with the reference punch, until the upper edge of the reference punch reaches the stored position value of the upper edge of the die. The difference between the reference punch and the reference die provides the distance measurement of the lower adaptor plate from the die plate.

By means of the disclosed method, therefore, the precise distance between the upper and/or lower adaptor plate and surface of the die plate may be accurately determined, for a given powder press. When installing forming tools, no further referencing is required, as the dimensions of the new forming tools are known and thus also, for example, the distance of the lower edge of the upper punch from the upper edge of the die. Thus each referencing process is dispensed with when the tools are changed, so that changing the tools may be automatically carried out. As a result, the cost is radically reduced when changing the tools.

With the solution according to claim 2, at least one reference punch and one reference die are also used. In this connection, both have to be simultaneously fitted and it is established by means of a force measuring device which is otherwise present, when the reference punch comes to bear against the reference die. To this end, it is necessary for the reference die to have a precise surface on which the reference punch may rest. The contact is established by a minimal force having to be achieved. This has to be low enough for the deformation of the reference tools to have not yet taken place. Also in this case, the sum and/or difference between the reference tools provides the distance between the adaptor plates.

In the method according to claim 1, as described, an optical measuring system is used which operates according to the principle of shadow measurement. In order to obtain sufficiently accurate values, in this case, the surface of the die plate, on which the dies are to be attached, are precisely polished. Thus, for example, the position measurement of the upper edge of the reference die has a precise position relative to the polished surface of the die plate.

As already described, the disclosed referencing process only needs to be carried out once. Further referencing is only required after modifications to the adaptor, its connection or to the distance measuring system. A referencing process is not necessary as long as the adaptor remains installed and only variable tools are attached.

The above embodiments refer to the so-called ejection process, in which the die plate is stationary. With so-called ejection processes, the lower punch is stationary and the die plate is actuated via an adaptor plate. In this case the distance of this adaptor plate from the lower punch has to be referenced, which is carried out in the same disclosed manner. In this connection, it is no longer possible for the optical measuring system to be arranged on the die plate or base plate, but has to be otherwise stationary, in order to determine the distance of the die-adaptor plate from the lower punch and/or the lower punch holder. The starting point is, therefore, the stationary position of the lower punch and/or a reference lower punch to which the measured positions of the reference upper punch and/or reference die refer.

The invention will be described in more detail hereinafter with reference to a drawing.

DETAILED DESCRIPTION OF THE INVENTION

Figure 1:
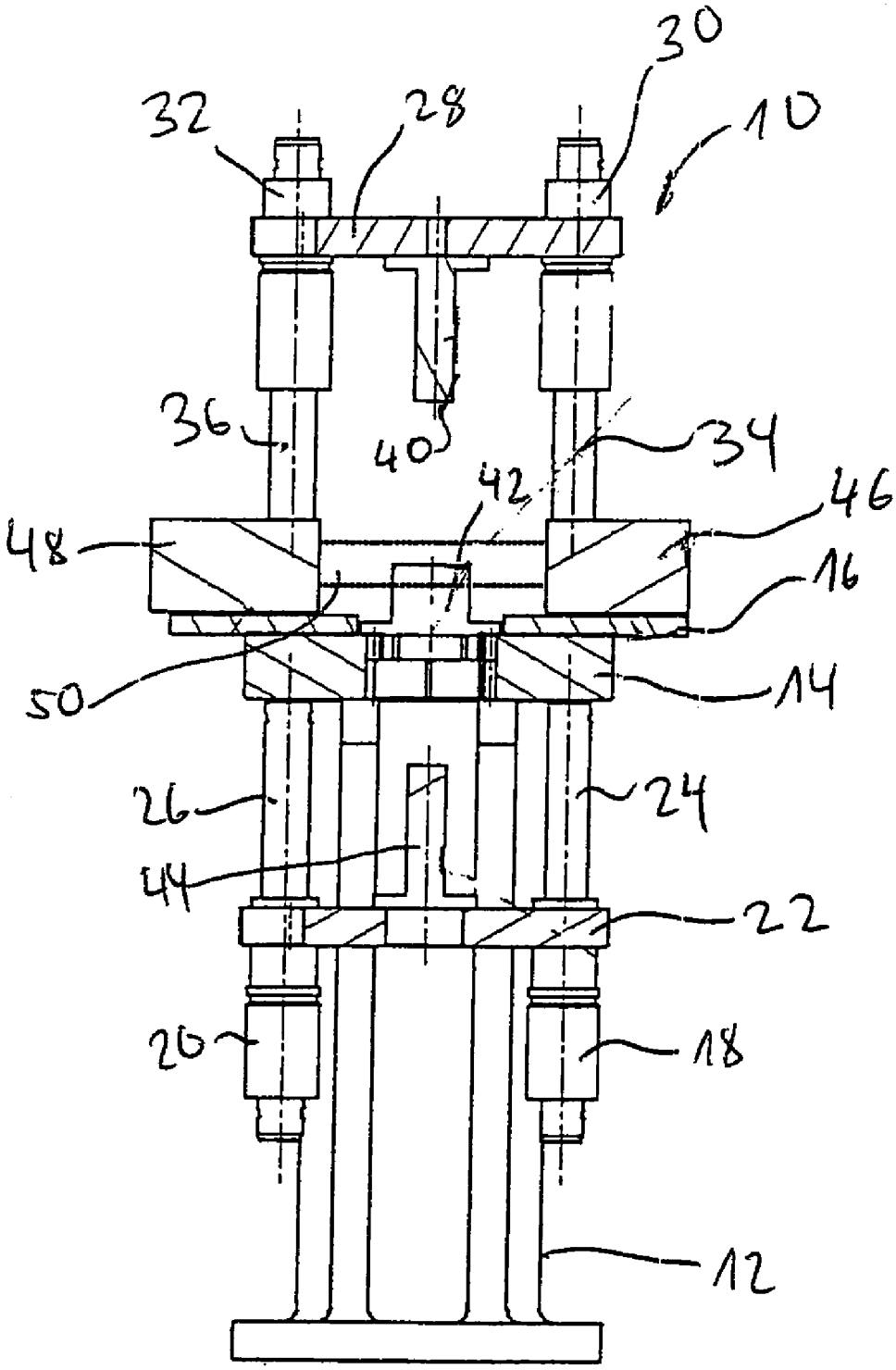
FIG. 1 shows diagrammatically in side view a powder press with a measuring system according to the invention.

While this invention may be embodied in many different forms, there are described in detail herein a specific preferred embodiment of the invention. This description is an exemplification of the principles of the invention and is not intended to limit the invention to the particular embodiment illustrated A powder press 10 comprises a frame 12 which carries a die plate 14. The die plate serves to attach a die (not shown). On the die plate 14 is attached a base plate 16 with a polished surface. On a frame (not shown) are attached hydraulic cylinders (not shown) on opposing sides, which engage on a lower adaptor plate 22 and an upper adaptor plate 28, which are precisely and vertically guided along vertical guide pillars or guide rails 24, 26, 34, 36 with guides 18, 20, 30, 32 or guide blocks. An upper adaptor plate 28 is actuated by means of hydraulic cylinders 30, 32 and is vertically guided along upper guide pillars 34, 36. The adaptor plates 22, 28 generally serve to attach an adaptor and an upper and lower punch may be connected to the adaptor. In this connection, the upper and lower punches may also consist of a plurality of punches. This is generally known. During compression, as is known, powder is filled into the cavity of the die and, by means of the drives, the upper and lower punches are driven into the cavity of the die, the lower punch being already located during the filling process within the die, in the known manner. During the forming process, the distance which the upper and lower punches travel is measured by means of an appropriate, accurate distance measuring device, not shown here. Moreover, by means of force measuring devices not shown, the forces acting on the punches are identified.

In the figure, a reference upper punch 40 is attached to the upper adaptor plate 28. A reference die 42 is attached to the die plate 14 and a reference lower punch 44 is attached to the lower adaptor plate. The reference punches 40, 44 and their reference die have precisely known dimensions.

A transmitter 46 of an optical measuring system is arranged on the upper surface of the base plate 16. On the opposing side, a receiver 48 of the measuring system is arranged on the base plate 16. The transmitter 46 produces a light strip 50. By means of the receiver 48, the position of the upper edge of the reference die 42 is able to be determined. This value is stored. Subsequently, the reference die is removed and the reference upper punch 40 moved downwards, until its lower edge reaches the measured position of the upper edge of the reference die 42. As the reference punch and reference die measurements are known, the distance between the adaptor plate 28 and the die plate 14 and/or the base plate 16 are known from the sum of the two dimensions. As the measurements of the adaptor and/or the forming tools are known, when installing the tools and when changing the tools no further referencing process is necessary because, as mentioned above, the position of the adaptor plate 28 is known relative to the die plate and/or base plate 14, 16.

The same method is carried out relative to the lower punch 44. This is moved upwards when the reference die 42 is removed until its upper edge reaches the measured position of the upper edge of the reference die 42. Thus the distance of the lower adaptor plate 22 from the upper face of the die plate and/or the base plate 16.is also known.

The method disclosed here may also be used during the withdrawal method. The reference punch 44 is then stationary and the base plate 24 is actuated by hydraulic cylinders. The measuring system 46, 48 may be otherwise arranged in a stationary manner, in order to determine and store the position of the reference lower punch and to designate the measured position of the reference upper punch 40 and the movable reference die 42, by for example the lower punch 44 being removed in order to move the upper punch to such an extent that its lower edge is moved into the stored position of the upper edge of the lower punch 44. The same is carried out with reference to the die 42.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. Method for determining a reference for a powder press, which comprises a die plate for attaching a die and an upper adaptor plate which may be actuated by a drive which is hydraulic, mechanical, electric or the like for attaching an upper punch, a lower adaptor plate which may be actuated by a hydraulic drive for attaching a lower punch or the die plate and at least one distance measuring system for the upper and lower punch and/or the die plate comprising the following steps:

providing a reference die and at least one reference punch with known reference punch measurements, attaching the reference die to the die plate, measuring the position of the upper edge of the reference die by an optical measuring device usefully arranged on a base plate and/or die plate, storing the position value, removing the reference die, moving the adaptor plate with the reference punch previously attached therein in the direction of the die until the lower edge of the reference punch has reached the stored position of the upper edge of the reference die, determining the sum of the reference die measurement and the known references punch measurement as the distance of the adaptor plate from the die plate, storing the sum, and removing the reference punch, so that both the reference die and reference punch are removed prior to application of normal tools for pressing purposes.

2. Method for determining a reference for a powder press, which comprises a die plate for attaching a die and an upper adaptor plate, which may be actuated by a hydraulic drive, for attaching an upper punch, a lower adaptor plate which may be actuated by a hydraulic drive for attaching a lower punch and/or the die plate and at least one distance measuring system for the upper and lower punch and a force measuring device for the upper and lower punch and/or the die plate comprising the following steps:

a reference die and at least one reference punch with known reference punch measurements are provided, the reference die is attached to the base plate and/or die plate and the reference punch is attached to the adaptor plate, the reference punch is moved towards the reference die until a predetermined, low value for the force is reached, when the reference punch comes to bear against the reference die, the sum of the reference die measurement and the known references punch measurement is obtained as the distance of the adaptor plate from the die plate and stored, and both the reference die and the reference punch are removed prior to application of normal tools for pressing purposes.

* * * * *